US006479799B2

(12) United States Patent
Morhenne et al.

(10) Patent No.: US 6,479,799 B2
(45) Date of Patent: Nov. 12, 2002

(54) YARN HEATING DEVICE

(75) Inventors: Siegfried Morhenne, Breckerfeld (DE); Wolfgang Nölle, Ennepetal (DE); Martin Fischer, Solingen (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/997,584

(22) Filed: Nov. 29, 2001

(65) Prior Publication Data

US 2002/0070207 A1 Jun. 13, 2002

Related U.S. Application Data

(63) Continuation of application No. PCT/EP00/04554, filed on May 19, 2000.

(30) Foreign Application Priority Data

May 29, 1999 (DE) ..... 199 24 874

(51) Int. Cl.[7] ..... D02J 13/00; D01H 7/92; H05B 3/02

(52) U.S. Cl. ..... 219/388; 57/290

(58) Field of Search ..... 219/388; 57/282, 57/284, 290

(56) References Cited

U.S. PATENT DOCUMENTS

| | | | | |
|---|---|---|---|---|
| 5,148,666 A | | 9/1992 | Bauer et al. | |
| 5,605,644 A | | 2/1997 | Morhenne | |
| 5,628,175 A | | 5/1997 | Fischer | |
| 5,628,176 A | | 5/1997 | Morhenne et al. | |
| 5,666,797 A | | 9/1997 | Bruske et al. | |
| 5,735,112 A | * | 4/1998 | Naito et al. | 57/290 |
| 5,768,877 A | | 6/1998 | Morhenne | |
| 6,138,448 A | * | 10/2000 | Kataoka | 57/290 |

FOREIGN PATENT DOCUMENTS

| | | | |
|---|---|---|---|
| DE | 4318695 | * | 12/1993 |
| DE | 44 04 217 A1 | | 9/1994 |
| DE | 44 23 202 A1 | | 1/1995 |
| DE | 196 50 677 A1 | | 6/1997 |
| DE | 19701829 | * | 7/1997 |
| EP | 0 412 429 A2 | | 2/1991 |
| EP | 0 691 429 A2 | | 1/1996 |
| EP | 0 705 925 A2 | | 4/1996 |
| EP | 0 731 197 B1 | | 9/1996 |
| EP | 784110 | * | 7/1997 |
| EP | 0 799 918 A1 | | 10/1997 |
| EP | 799918 | * | 10/1997 |
| EP | 0 905 295 A1 | | 3/1999 |
| EP | 994206 | * | 4/2000 |
| JP | 8-60480 | * | 3/1996 |
| WO | WO94/29501 A1 | | 12/1994 |

* cited by examiner

*Primary Examiner*—Joseph Pelham
(74) *Attorney, Agent, or Firm*—Alston & Bird LLP

(57) ABSTRACT

A heating device for heating at least one advancing yarn in a texturing machine, wherein the body of the heating device defines an elongate heating channel. The heating channel accommodates an exchangeable support which mounts a plurality of yarn guides which are arranged inside the heating channel for forming a plurality of adjacent yarn guide tracks for guiding a plurality of yarns in such a manner that the yarns advance in a yarn advancing plane extending at a predetermined distance from the bottom wall of the heating channel.

12 Claims, 2 Drawing Sheets

YARN HEATING DEVICE

CROSS REFERENCE TO RELATED APPLICATION

This is a continuation of international application PCT/EP00/04554 filed May 19, 2000, and designating the U.S.

BACKGROUND OF THE INVENTION

The present invention relates to a heating device for heating an advancing yarn in a texturing machine or the like.

Such heating devices are used in particular for crimping synthetic yarns in a false twist texturing machine, through which the yarn advances and is crimped. In so doing, the yarn advances in a heating channel, which is heated on its walls to a surface temperature that is above the melt point of the yarn. To this end, the heating channel contains a plurality of yarn guides, which guide the yarn at a distance from the walls of the heating channel. The yarn guides may be arranged on a support, which is exchangeably arranged in the heating channel. A heating device of this kind is disclosed, for example, in EP 0 731 197 and corresponding U.S. Pat. No. 5,628,176.

To set a twist previously imparted to the yarn, a heat treatment is needed, which covers the entire yarn cross section, so that in the known heating device, each yarn is guided in a separate heating channel. This ensures that in the case of multifilament yarns, each of the filaments receives an intensive heat treatment for crimping. The known heating device is unsuitable for the heat treatment of a plurality of parallel advancing yarns.

DE 196 50 677 discloses a heating device, which is used for heating a group of advancing yarns. In this process, the group of yarns advances in a heating channel in a yarn advancing plane parallel to the side walls of the heating channel. Such arrangements are unsuitable for use in texturing machines, inasmuch as they do not permit uniform heat treatment for crimping the individual yarns because of heat losses, in particular toward the edge of the group of yarns.

EP 0 905 295 discloses a heating apparatus for heating an advancing yarn, wherein the yarns are guided in a yarn advancing plane, which extends in spaced relationship with a heated wall. However, the publication provides no indication of how the yarn path can be stabilized, so that the yarn undergoes a uniform temperature treatment.

It is accordingly an object of the invention to further develop a heating device of the initially described kind such that one or more yarns advancing side by side receive a uniform heat treatment.

SUMMARY OF THE INVENTION

The above and other objects and advantages of the invention are achieved by the present invention and wherein an arrangement of the yarn guides within the heating channel is selected such that they form a plurality of yarn guide tracks extending side by side for guiding a plurality of yarns, and wherein the yarns advance at a predetermined distance from the channel bottom wall. A special advantage of the invention lies in that, regardless whether one or more yarns advance in the heating device, the yarns advance substantially at the same distance from the bottom wall. The plane of the advancing yarns as well as the distance from the bottom wall are selected such that substantially the same heating times, heating intensities, and frictions are effective on each individual yarn.

To obtain a stable yarn path in the heating channel with the least possible contact and, thus, the least possible looping friction, the yarn guides are arranged relative to one another such that zigzag yarn guide tracks form, in which the yarns advance.

The invention has the special advantage that when a plurality of parallel extending yarns advance through a heating channel, each of the yarns is subjected to a substantially identical ambient temperature. With that, there also exists the possibility of operating the heating device either with one yarn or with a plurality of yarns.

According to a preferred embodiment of the invention, the yarn path plane formed by the yarn guides, in which the yarns advance, extends substantially parallel to the bottom wall of the channel. As a result, the yarns advance at a constant distance from the heating channel, so that a particularly uniform temperature influence on the yarns is realized. Because of the unilateral opening of the heating channel, which is closed in operation by a cover, a temperature gradient develops between the channel bottom wall and the cover side of the heating channel. Inside the channel, the yarns advance at one level within the channel, so that temperature gradients in the heating channel exert no influence on the tempering of the yarns.

In this connection, the arrangement of a particularly preferred further development of the invention results in that a very uniform treatment of the yarns within the heating channel. To this end, the number and the arrangement of the yarn guides are selected such that adjacent yarn guide tracks have between each other a distance which remains substantially unchanged in the longitudinal direction of the heater.

Another development of the invention is used preferably in texturing machines, wherein two yarns are combined to one yarn upstream of the takeup. In this type of plying, it is often desired to have different heat treatments for the individual yarns, so that different types of yarn guide tracks are realized in a simple manner.

To ensure that the support inserted into the heating channel and the yarn guides arranged thereon permit heating the yarns as unimpeded as possible, it is preferred to make the support of a thermally conductive material. In this instance, the yarn guides are made of a ceramic or coated with ceramic, so that they exhibit a high resistance to wear. This results in particular in a long service life of the yarn guides. Furthermore, ceramic has the property that it decreases the tendency as exists in the case of conventional steel yarn guides, namely to accumulate inorganic components of the yarn, and that it shows less wear.

In a particularly preferred development of the invention, the support consists of a highly heat conductive material and is designed and constructed as a profiled rail which is shaped to define a plurality of parallel extending guide channels. The external profiled walls of the profiled rail are mounted to the walls of the heating channel. This arrangement realizes a very stable yarn path in the heating channel. In this connection, there exists even the possibility that the guide channels define the yarn guide track, and that thus the yarn advances directly in the rail.

To be able to realize a zigzag yarn guide track, it is possible to mold the yarn guides to the profiled rail. However, it is also possible to insert a plurality of ceramic yarn guides into each of the guide channels of the profiled rail. In this instance, recesses in the heating rail make it possible to produce holding means for such yarn guides in a simple manner.

It is preferred to design and construct the yarn guides with an L-shaped yarn guide edge, so that the spacings between the yarn and the side walls of the heating channel, as well as between the yarn and the bottom wall of the heating channel are defined by the yarn guide edge. Likewise, this measure leads to an equalization of the temperature treatment of the yarn within the heating channel.

In a particularly advantageous further development of the invention, the profiled rail is formed by a plurality of U-shaped individual rails. The individual rails are connected along their opposite longitudinal sides, so that no heat blockade develops between the individual yarn guide tracks.

BRIEF DESCRIPTION OF THE DRAWINGS

Further advantages, characteristics, and possibilities of application of the present invention are described below with reference to the accompanying drawings, in which.

DETAILED DESCRIPTION OF THE PREFERRED EMBODIMENTS

Figure 1:
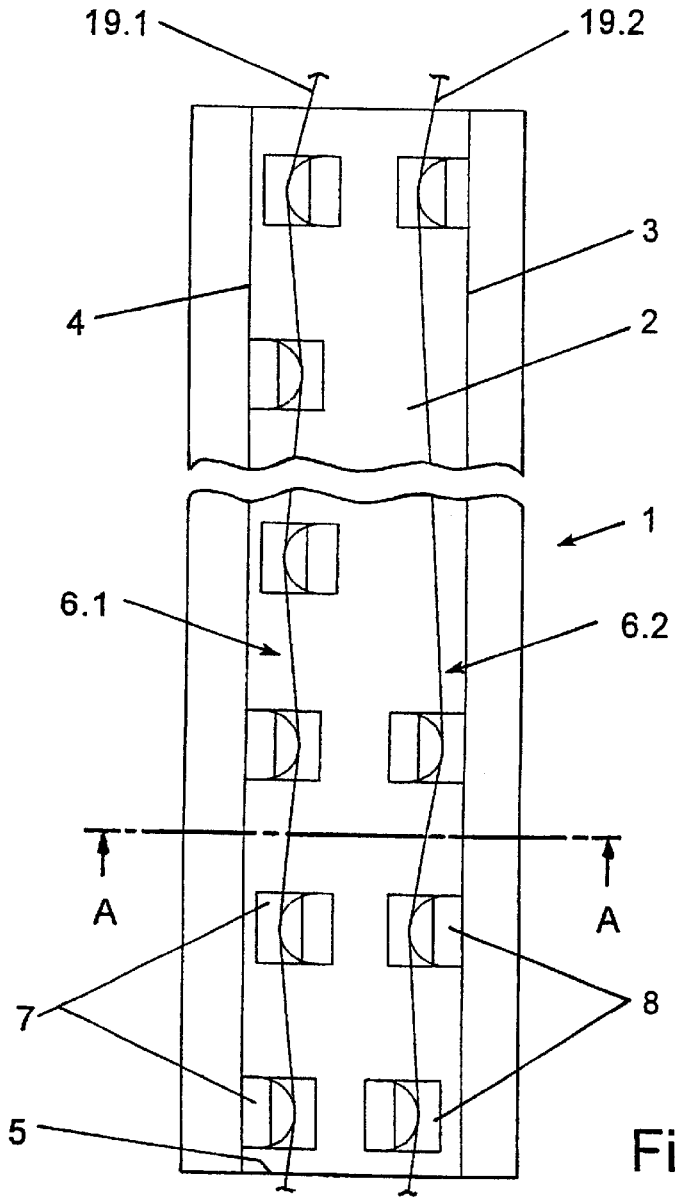
FIG. 1 is a schematic top view of a heating device having a heating channel according to the invention.
Figure 2:
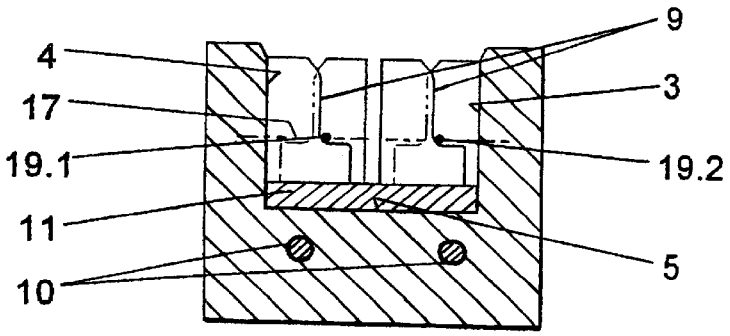
FIG. 2 is a schematic cross sectional end view of the heating device of FIG. 1 perpendicular to the plane of the advancing yarn and taken along the line A—A in FIG. 1.

FIGS. 1 and 2 illustrate a first embodiment of a heating device according to the invention, and wherein the heating device includes an elongate heater body 1, which typically has a length from 0.5 to 2 meters. In the heater body 1, a heating channel 2 is formed that is open to one side, and extends in the longitudinal direction. The heating channel 2 is defined in the heater body 1 by parallel side walls 3, 4, and a bottom wall 5.

Below the channel bottom wall 5, the heater body 1 encloses two electric heating elements 10. The heater body 1 consists of a highly heat conductive material, so that the heating elements 10 heat the walls 3, 4, and 5 of the heating channel 2, preferably to a temperature approximately to or above the melt point of the yarn being processed.

In the heating channel 2, a support 11 is embedded so as to be substantially flush with the inner surface of the bottom wall 5. On its side opposite to the bottom wall 5, the support 11 mounts a plurality of yarn guides 7 and 8 that project into the heating channel 2. The yarn guides 7 extend in two parallel lines and in spaced relationship in the longitudinal direction, and form between them a yarn guide track 6.1. Also, the yarn guides 7 each have a yarn guide edge 9, which faces an advancing yarn 19.1. In this connection, the yarn guide track 6.1 constitutes the guide track, through which the yarn 19.1 advances in the heating channel 2. The yarn guides 7 are arranged with their yarn guide edges 9 alternatingly on opposite sides, so that the yarn guide track 6.1 is of zigzag form.

The yarn guides 8 extend in two lines parallel to the yarn guides 7, and form a yarn guide track 6.2. Likewise, the yarn guides 8 are arranged with their guide edges 9 alternatingly on opposite sides in spaced relationship with one another, so that they form a zigzag yarn guide track 6.2. In the illustrated embodiment, the yarn guide tracks 6.1 and 6.2 are formed by a different number of yarn guides 7 and 8. In the yarn guide track 6.2, the inlet region of the heater comprises a plurality of yarn guides 8 arranged one after another at short intervals, with no yarn guides in the center region. In comparison therewith, the yarn guide track 6.1 is formed by a number of yarn guides 7 which are arranged offset from one another in an evenly spaced relationship.

FIG. 2 is an end view of the yarn guides 7 and 8. The yarn guides 7 and 8 each have an L-shape yarn guide edge 9. The L-shaped yarn guide edge 9 is used to achieve a guidance of the yarn that is defined by its spacings from the side walls 3 and 4, as well as from the bottom wall 5. The yarn guide edges 9 of the yarn guides 7 and 8 define a yarn advancing plane 17, which is substantially parallel to the bottom wall 5. With that, the yarns 19.1 and 19.2 advance through the heating channel 2 at one level.

In the embodiment shown in FIGS. 1 and 2, the yarn guides are projectingly mounted to the support 11. Preferably, the yarn guides are made from a ceramic material. However, it is also possible to use pin-shaped yarn guides with a metallic surface.

In the present embodiment, the arrangement of the yarn guides 7 and 8 is selected such that different yarn guide tracks 6.1 and 6.2 form in the heating channel. It is preferred to use a heating device of this kind for heat treating yarns, which are subsequently combined to one yarn and wound.

Figure 3:
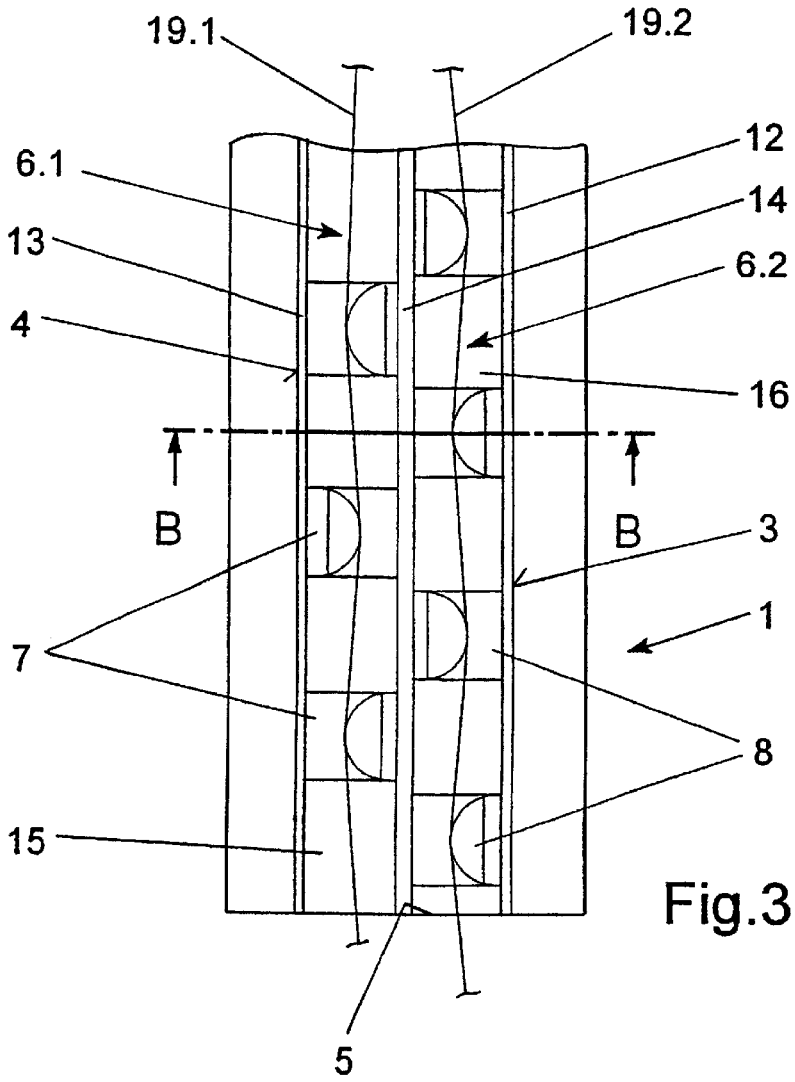
FIG. 3 is a schematic view of a further embodiment of a heating device according to the invention.
Figure 4:
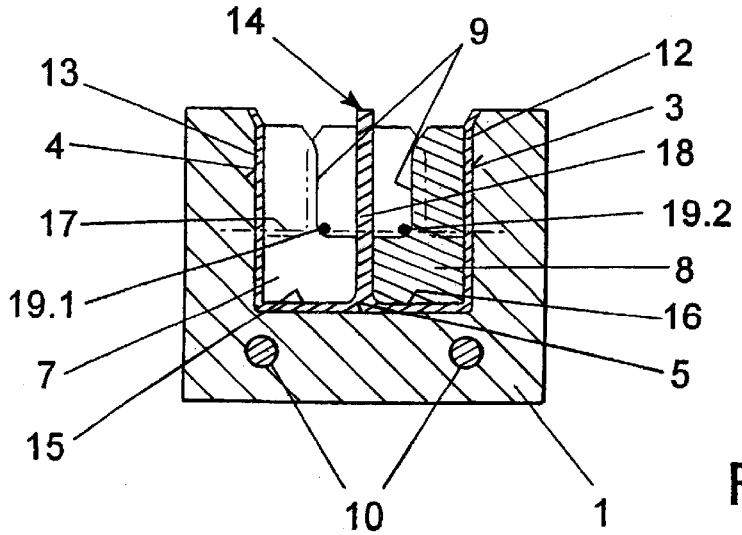
FIG. 4 is a schematic cross sectional end view of the heating device of FIG. 3 perpendicular to the plane of the advancing yarn and taken along the line B—B in FIG. 3.

In the production of textured individual yarns, it is preferred to use the arrangement of the yarn guides 7 and 8, as shown in FIGS. 3 and 4. In this embodiment, components with the same functions have been provided with the same numerals. In its basic construction, the heating device is identical with the previously described embodiment. To this extent, the foregoing description is herewith incorporated by reference.

In the case of the heating device shown in FIGS. 3 and 4, a profiled rail 14 is inserted as a support into the heating channel 2. The profiled rail 14 defines two guide channels 15 and 16 extending in the longitudinal direction of the heating device, with each being defined by profiled walls 12 and 13. The profiled rail 14 is likewise open to the open side of the heating channel. The profiled walls 12 and 13 lie against the side walls 3 and 4 of the channel 2. The guide channels 15 and 16 of the profiled rail 14 are separated from each other by a center ridge 18.

In the guide channel 15 of the profiled rail 14, the yarn guides 7 are arranged in spaced relationship, one after another in one plane which lies in the longitudinal direction. The yarn guide edges 9 of the adjacent yarn guides 7 are arranged offset from one another on opposite sides, so as to form a zigzag yarn guide track 6.1 in the guide channel 15.

In the guide channel 16, the yarn guides 8 are arranged in one line offset from the yarn guides 7. However, it is also possible to arrange the yarn guides 8 symmetrically to the yarn guides 7. The yarn guides 8 are likewise arranged in spaced relationship alternatingly with their yarn guide edges 9 on opposite sides in such a manner that the yarn guide track 6.2 is zigzagged. Thus, the yarn guides 7 and 8 describe a yarn advancing plane 17, which is defined by the yarn guide edges 9 of the yarn guides 7 and 8. The yarn advancing plane 17 extends substantially parallel to the channel bottom 5.

In the case of the illustrated yarn guides 7 and 8, the surface of the yarn guides facing the yarn is rounded, so that during its advance over the yarn guide edge 9, the yarn is able to extend gently over the surfaces thereof. The yarn guide may be L-shaped in cross section, so that it has the shape of a boot. The boot shape of the yarn guide 7 or 8 is defined by an upright portion and a horizontal instep portion. To mount the yarn guides, it is possible to provide recesses in the profiled rail 14, so that the yarn guides 7 or 8 can be exchangeably inserted into the profiled rail 14.

In the described embodiments, the support 11 or profiled rail 14 is easy to remove from the heating channel 2, for example, for purposes of cleaning the yarn guides, and to replace after the cleaning is completed.

In the embodiment of FIGS. 3 and 4, the profiled rail 14 is made, for example, in one piece. It is also possible to form the profiled rail 14 from two joined U-shaped individual rails. Each of the individual rails comprises a guide channel, which mounts the yarn guides. The individual rails are interconnected along their opposite longitudinal sides. An illustration of this embodiment has been omitted, since its construction can be noted from FIGS. 3 and 4, wherein the center ridge 18 would be formed by the joined longitudinal sides of the individual rails.

When heating devices of this kind are used, the heater 1 is surrounded by an insulating material. On the open side of the heating channel, a cover connected to the heater 1 and the insulating material is provided, so as to avoid a great loss of heat. For the sake of clarity, these components are not shown in the illustrated embodiments and not described in greater detail.

To heat parallel advancing yarns differently, it is also possible to construct the yarn guides 7 and 8 with different yarn guide edges 9, so that they define a yarn advancing plane that is oblique relative to the channel bottom wall 5. It would thus be possible to guide the yarns through the heating channel at different levels.

In the foregoing embodiments, the arrangement of the yarn guides and the configuration of the yarn guide tracks are exemplary. Basically, any arrangement of the yarn guides within the heating channel is possible to obtain symmetrical or asymmetrical yarn guide tracks. Likewise, the number of the yarn guide tracks is not limited to two. Thus, it would be possible to guide side by side more than two yarns through the heating channel.

What is claimed is:

1. A device for heating an advancing yarn comprising an elongate heater body having a channel therein which extends in a longitudinal direction along the length thereof, with the channel defining opposite side walls and a bottom wall, a heater for heating the side and bottom walls to a surface temperature approximately to or above the melt point of the yarn to be processed, a yarn guide support positioned in the channel and mounting a plurality of yarn guides so as to form a plurality of side-by-side yarn guide tracks which extend longitudinally along the channel at a distance from each of the side and bottom walls and for guiding a plurality of yarns in such a manner that the yarns are guided in a predetermined spaced relationship to the bottom wall and in a zigzagged manner.

2. The heating device of claim 1, wherein the yarn guides support the yarn in a yarn advancing plane which extends substantially parallel to the bottom wall, so that the yarns advance at a constant distance from the bottom wall.

3. The heating device of claim 1, wherein the number and the arrangement of the yarn guides are selected such that adjacent yarn guide tracks have between them a distance that remains substantially constant in the longitudinal direction of the heater.

4. The heating device of claim 1, wherein the number and the arrangement of the yarn guides are selected such that adjacent yarn guide tracks have between them a distance that differs in the longitudinal direction of the heater.

5. The heating device of claim 1, wherein the yarn guide support consists of a highly heat conductive material and lies against the bottom wall of the channel, and the yarn guides comprise ceramic or a ceramic coated material and are mounted on the support to project therefrom.

6. The heating device of claim 1, wherein the yarn guide support consists of a highly heat conductive material and is designed and constructed as a profiled rail which defines a plurality of parallel extending guide channels, and the profiled rail includes external profiled walls which lie against the side walls of the heating channel.

7. The heating device of claim 6, wherein the yarn guides comprise ceramic or a ceramic coated material, and are mounted in the guide channels of the profiled rail for forming respectively one yarn guide track per guide channel.

8. The heating device of claim 7, wherein the yarn guides each comprise an L-shaped yarn guide edge, so that the spacings between the yarn guide track and the side walls of the heating channel, as well as between yarn guide track and the bottom wall of the heating channel are defined by the yarn guide edge.

9. The heating device of claim 8, wherein the profiled rail is defined by a plurality of U-shaped individual rails, with the individual rails being interconnected on their opposite longitudinal sides.

10. The heating device of claim 1, wherein the yarn guides each comprises an L-shaped yarn guide edge so as to define a bottom leg which is generally parallel to the bottom wall of the channel and an upright leg which extends upwardly from the bottom wall.

11. The heating device of claim 10, wherein the upright legs of the yarn guide edges each have a rounded surface which is positioned to engage the yarn.

12. The heating device of claim 11, wherein the yarn guide support comprises a plate removably mounted to overlie the bottom wall of the channel, with the yarn guides mounted to the plate.

* * * * *